US008794626B2

(12) United States Patent
Takenaka et al.

(10) Patent No.: US 8,794,626 B2
(45) Date of Patent: Aug. 5, 2014

(54) SHEET THICKNESS DETECTING DEVICE, FEEDING DEVICE, AND IMAGE FORMING APPARATUS

(71) Applicants: Ryo Takenaka, Tokyo (JP); Shingo Nishizaki, Kanagawa (JP); Yusuke Ozaki, Tokyo (JP); Masashi Satoh, Kanagawa (JP); Hiroshi Adachi, Kanagawa (JP); Hiroshi Okamura, Tokyo (JP); Naohiro Funada, Kanagawa (JP); Yuji Ikeda, Kanagawa (JP)

(72) Inventors: Ryo Takenaka, Tokyo (JP); Shingo Nishizaki, Kanagawa (JP); Yusuke Ozaki, Tokyo (JP); Masashi Satoh, Kanagawa (JP); Hiroshi Adachi, Kanagawa (JP); Hiroshi Okamura, Tokyo (JP); Naohiro Funada, Kanagawa (JP); Yuji Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/756,684

(22) Filed: Feb. 1, 2013

(65) Prior Publication Data

US 2013/0200565 A1 Aug. 8, 2013

(30) Foreign Application Priority Data

Feb. 7, 2012 (JP) ..... 2012-023688

(51) Int. Cl.
*B65H 7/12* (2006.01)
*B65H 7/02* (2006.01)

(52) U.S. Cl.
USPC ..... 271/262; 271/265.04

(58) Field of Classification Search
USPC ..... 271/265.04, 262, 258.01, 265.01
See application file for complete search history.

(56) References Cited

U.S. PATENT DOCUMENTS

| | | | | |
|---|---|---|---|---|
| 6,000,693 | A * | 12/1999 | Tranquilla | 271/263 |
| 6,655,683 | B2 * | 12/2003 | Engarto et al. | 271/265.04 |
| 6,734,417 | B2 * | 5/2004 | Vejtasa | 250/231.13 |
| 6,850,717 | B2 * | 2/2005 | Fujikura et al. | 399/45 |
| 7,992,858 | B2 * | 8/2011 | Sagawa et al. | 271/10.01 |
| 8,282,096 | B2 * | 10/2012 | Pan et al. | 271/265.04 |
| 2004/0065996 | A1 * | 4/2004 | Ko et al. | 271/262 |
| 2005/0280205 | A1 * | 12/2005 | Knierim | 271/265.04 |
| 2006/0157921 | A1 * | 7/2006 | Ahn et al. | 271/258.01 |
| 2007/0018383 | A1 * | 1/2007 | Ohara et al. | 271/262 |
| 2008/0211165 | A1 * | 9/2008 | Kusumi | 271/9.07 |
| 2011/0210505 | A1 * | 9/2011 | Tomii et al. | 271/265.04 |
| 2011/0210506 | A1 * | 9/2011 | Yamazaki et al. | 271/265.04 |
| 2014/0015192 | A1 * | 1/2014 | Wakabayashi et al. | 271/110 |

FOREIGN PATENT DOCUMENTS

| | | |
|---|---|---|
| JP | 2004-252233 | 9/2004 |
| JP | 4152136 | 9/2008 |
| JP | 2010-058961 | 3/2010 |
| JP | 4579312 | 11/2010 |

* cited by examiner

*Primary Examiner* — Patrick Cicchino
(74) *Attorney, Agent, or Firm* — Harness, Dickey & Pierce, P.L.C.

(57) ABSTRACT

A sheet thickness detecting device for detecting a thickness of a sheet includes a fixed roller rotatably supported by a shaft so that the fixed roller faces the sheet; a movable roller rotatably provided so that the movable roller and the fixed roller sandwich and feed the sheet, and configured to be displaced in accordance with the thickness of the sandwiched sheet; a swing member rotatably supporting the movable roller and including a shaft so that the swing member is swung around the shaft, wherein the swing member further includes a detection target part formed in a manner that a distance between the detection target part and the shaft is greater than that between a position where the movable roller is supported by the swing member and the shaft; and a detecting unit detecting the displacement amount of the detection target part of the swing member.

15 Claims, 4 Drawing Sheets

SHEET THICKNESS DETECTING DEVICE, FEEDING DEVICE, AND IMAGE FORMING APPARATUS

CROSS-REFERENCE TO RELATED APPLICATIONS

The present application claims priority under 35 U.S.C §119 to Japanese Patent Application No. 2012-023688 filed Feb. 7, 2012, the entire contents of which are hereby incorporated herein by reference.

BACKGROUND OF THE INVENTION

1. Field of the Invention

The present invention generally relates to a sheet thickness detecting device detecting the thickness of a sheet passing through a conveying path, a feeding device including the sheet thickness detecting device, and an image forming apparatus such as a copier, a printer, a facsimile machine, a multifunctional peripheral including thereof and the sheet thickness detecting device.

2. Description of the Related Art

To detect a thickness of a sheet passing through a conveying path in an image forming apparatus including a copier, a printer and the like, there has been known a technique using a detecting unit that detects the thickness (sheet thickness) of a sheet (e.g., a sheet material, a recording medium) fed on the conveying path, so as to vary an image forming condition and a feeding condition based on the detection result (see for example in Patent Documents 1 and 2).

Patent Document 1: Japanese Laid-open Patent Publication No. 2004-252233

Patent Document 2: Japanese Patent No. 4152136

Specifically, to detect the sheet thickness, a feeding roller pair including a fixed roller and a movable roller is provided in a conveying path to an image forming part and on the upstream side of the image forming part, so as to detect the displacement amount of the moving roller moving in accordance with the thickness of a sheet by using a detecting unit (sheet thickness detecting unit) while the sheet is sandwiched and fed by the feeding roller pair.

By using an image forming apparatus including such a detecting mechanism, it is no longer necessary for an operator to input data indicating the sheet thickness whenever the operator sets a sheet in the apparatus main body. Therefore, such an image forming apparatus may be an easy-to-use apparatus.

On the other hand, in Patent Document 2 and the like, a technique is disclosed that is aimed to accurately measure the sheet thickness by contacting one end of a lever rotating around a shaft with respect to a moving roller and by detecting the displacement amount of the other end of the lever using a sensor so as to indirectly detect the sheet thickness.

SUMMARY OF THE INVENTION

According to an aspect of the present invention, a sheet thickness detecting device for detecting a thickness of a sheet passing through a conveying path includes a fixed roller rotatably supported by a shaft so that the fixed roller faces one side of the sheet passing through the conveying path; a movable roller rotatably provided so that the movable roller and the fixed roller sandwich and feed the sheet, and being displaced in accordance with the thickness of the sandwiched sheet; a swing member rotatably supporting the movable roller and including a shaft so that the swing member is swung around the shaft, wherein the swing member further includes a detection target part formed in a manner that a distance between the detection target part and the shaft is greater than a distance between a position where the movable roller is supported by the swing member and the shaft; and a detecting unit detecting the displacement amount of the detection target part of the swing member.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
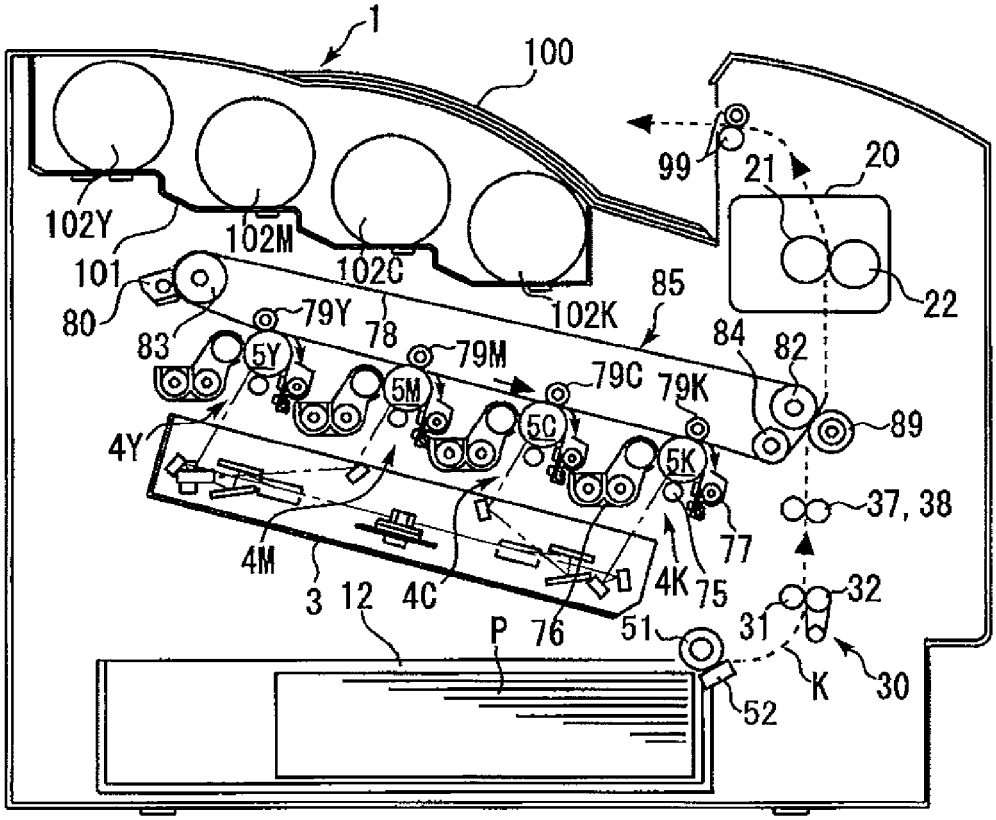
FIG. 1 schematically illustrates an example configuration of an image forming apparatus according to an embodiment.

In related art, it may not be possible to accurately detect the thickness of a sheet passing through the conveying path by using a detecting unit. Accordingly, it may not be possible to accurately adjust an image forming condition or a feeding condition to be varied depending on the detection result of the detecting unit.

Especially, in the technique of Patent Document 2, the level contacting the movable (displaceable) roller is unlikely to accurately move in accordance with the displacement of the moving roller. As result, there is a high possibility of inaccurately detecting the sheet thickness.

The present invention is made in light of the above problem, and may provide a sheet thickness detecting device, a feeding device, and an image forming apparatus capable of accurately detecting the thickness of a sheet passing in the conveying path.

In the description, as definition, a term "sheet" refers to any type of recording media. Namely, the "sheet" may include not only a general transfer sheet but also a special sheet such an Over Head Projector (OHP) sheet and a coated sheet.

According to an embodiment, a fixed roller and a movable roller are provided to sandwich and feed a sheet in a conveying path. The movable roller is displaced in accordance with the thickness of the sandwiched sheet. The swing member is swung around a shaft in accordance with the displacement of the movable roller.

The swing member includes a detection target part in a manner that the distance between the detection target part and the shaft is greater than the distance between the movable roller and the shaft. A detection unit detects the distance from the detection target part. By doing this, it may become possible to more accurately detect the thickness of the sheet in the conveying path.

Embodiment

In the following, embodiments of the present invention are described in detail with reference to the drawings. In the figures, the same reference numerals are used to describe the same or equivalent elements, and the repeated descriptions thereof may be omitted.

First, with reference to FIG. 1, an example configuration and example operation in the entire image forming apparatus are described.

As shown in FIG. 1, an image forming apparatus 1 according to an embodiment is a tandem-type color printer. There are four toner bottles 102Y, 102M, 102C, and 102K corresponding to yellow, magenta, cyan, and black colors are removably (exchangeably) provided in a bottle container 101 in the upper part of the main body of the image forming apparatus 1.

Under the bottle container 101, there is provided an intermediate transfer unit 85. Also, there are arranged side by side image forming units 4Y, 4M, 4C, and 4K corresponding to yellow, magenta, cyan, and black colors so as to face an intermediate transfer belt 78 of the intermediate transfer unit 85.

In the bottom part of the main body of the image forming apparatus 1, there is provided a sheet supply unit 12 (sheet supply cassette) accommodating a plurality of stacked sheets P (recording media, sheet materials).

The image forming units 4Y, 4M, 4C, and 4K includes respective photoconductive drums 5Y, 5M, 5C, and 5K. Near the photoconductive drums 5Y, 5M, 5C, and 5K, there are disposed respective charging units 75, development units 76, cleaning units 77, discharging units (not shown), and the like. Further, an image forming process (including a charging process, an exposing process, a development process, a transfer process, and a cleaning process) is performed on the photoconductive drums 5Y, 5M, 5C, and 5K, so as to form images thereon in the respective colors.

The photoconductive drums 5Y, 5M, 5C, and 5K (i.e., image carriers) are driven to rotate in the clockwise direction in FIG. 1 by a driven motor (an image forming motor) (not shown). In this case, the surfaces of the photoconductive drums 5Y, 5M, 5C, and 5K are uniformly charged when the surfaces are at the positions of the respective charging units 75 (charging process).

After that, the surfaces of the photoconductive drums 5Y, 5M, 5C, and 5K are moved to the positions where the respective laser lights L from an exposure unit 3 are exposed. At the positions, by performing exposure scanning, the electrostatic latent images in the respective colors are formed (exposing process).

After that, the surfaces of the photoconductive drums 5Y, 5M, 5C, and 5K are moved to the positions facing the respective development units 76. At the positions, the electrostatic latent images are developed, so that toner images in the respective colors are formed (development process).

After that, the surfaces of the photoconductive drums 5Y, 5M, 5C, and 5K are moved to the positions facing the intermediate transfer belt 78 and respective primary transfer bias rollers 79Y, 79M, 79C, and 79K. At the positions, the toner images on the photoconductive drums 5Y, 5M, 5C, and 5K are transferred on the intermediate transfer belt (primary transfer process). After that, a slight amount of non-transferred toner remains on the photoconductive drums 5Y, 5M, 5C, and 5K.

After that, the surfaces of the photoconductive drums 5Y, 5M, 5C, and 5K are moved to the positions facing the respective cleaning units 77. At these positions, the non-transferred toner remaining on the photoconductive drums 5Y, 5M, 5C, and 5K are mechanically collected by a cleaning blade of the cleaning units 77 (cleaning process).

Finally, the surfaces of the photoconductive drums 5Y, 5M, 5C, and 5K are moved to the positions facing the respective discharging units. At these positions, residual potential on the photoconductive drums 5Y, 5M, 5C, and 5K is removed.

By doing this, a series of image forming processes performed on the photoconductive drums 5Y, 5M, 5C, and 5K is completed.

After that, the toner images formed on the photoconductive drums in the respective colors are transferred on the intermediate transfer belt 78 serving as an image carrier. By doing this, a color image is formed on the intermediate transfer belt 78.

Here, the intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, an intermediate transfer cleaning unit 80 and the like.

The intermediate transfer belt 78 is stretched and supported by three rollers 82, 83, and 84, and is driven so as to endlessly move in the arrow direction of FIG. 1 by the rotation of the secondary transfer backup roller 82 which is connected to a driven motor (image forming motor) (not shown).

The four primary transfer bias rollers 79Y, 79M, 79C, and 79K and the respective photoconductive drums 5Y, 5M, 5C, and 5K sandwich the intermediate transfer belt 78, so as to form primary transfer nip sections. Further, a transfer bias voltage having a polarity opposite to that of the toner is applied to the primary transfer bias rollers 79Y, 79M, 79C, and 79K.

Further, the intermediate transfer belt 78 is moved in the arrow direction, and sequentially passes through the primary nip sections formed by the primary transfer bias rollers 79Y, 79M, 79C, and 79K. By ding this, the toner images on the photoconductive drums 5Y, 5M, 5C, and 5K and in the respective colors are primarily transferred on the intermediate transfer belt 78.

After that, the intermediate transfer belt 78 on which the toner images in colors are sequentially transferred is fed to a position facing a secondary transfer roller 89. At that position, a secondary nip section is formed by sandwiching the intermediate transfer belt 78 with the secondary transfer backup roller 82 and a secondary transfer roller 89.

Further, the toner image formed on the intermediate transfer belt 78 using the four colors is transferred on a sheet P fed to the secondary nip section. In this case, non-transferred toner which has not been transferred on the sheet P remains on the intermediate transfer belt 78.

After that, the intermediate transfer belt 78 is fed to a position of the intermediate transfer cleaning unit 80. At the position, the non-transferred toner on the intermediate transfer belt 78 is collected.

By doing this, a series of transfer process performed on the intermediate transfer belt 78 is completed.

Here, the sheet P fed to the position of the secondary nip section has been fed from the sheet supply unit 12 formed on the bottom part of the main body of the image forming apparatus 1 via a conveying path K.

Figure 2:
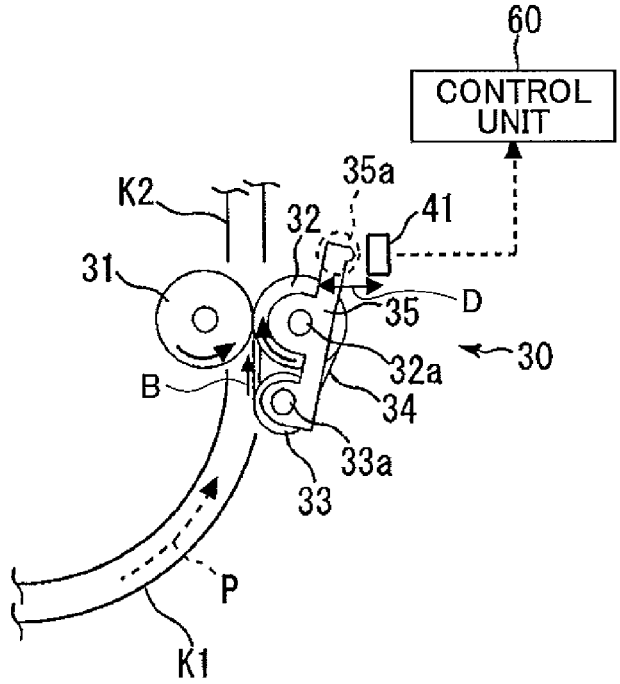
FIG. 2 illustrates an example sheet thickness detecting device according to an embodiment and in the vicinity thereof.

More specifically, there are a plurality of stacked sheets P such as transfer sheets accommodated in the sheet supply unit 12. Further, when a sheet feeding roller 51 is driven to rotate in the counterclockwise direction of FIG. 1, only a top sheet P sandwiched between the sheet feeding roller 51 and a friction pad 52 is guided by a feeding device (see also FIG. 2 illustrating a sheet thickness detecting device 30 and plural feeding rollers and a guide plate) to the position between a resist roller pair 37 and 38.

The movement of the sheet P fed to the resist roller pair 37 and 38 (timing roller pair) is temporarily stopped at the position of a roller nip (nip section) of the resist roller pair 37 and 38 whose driven rotations are stopped.

Further, in synchronization with the timing of the color image on the intermediate transfer belt 78, the resist roller pair 37 and 38 is driven to rotate to feed the sheet P to the secondary transfer nip (image forming unit). By doing this, a desired color image may be transferred on the sheet P.

After that, the sheet P on which the color image is transferred at the position of the secondary transfer nip is further fed to the position of a fixing unit 20. At the position, due to heat and pressure by a fixed roller 21 and a pressing roller 22, the color image transferred on the surface is fixed to the surface of the sheet P.

After that, the sheet P is discharged outside the device between rollers of a sheet discharging roller pair 99. The sheet P discharged by the discharging roller pair 99 is sequentially stacked on a stack unit 100.

By doing this, a series of image forming processes in the image forming apparatus is completed.

Next, details of the sheet thickness detecting device 30 according to an embodiment are described with reference to FIGS. 2 through 4.

FIG. 2 illustrates the sheet thickness detecting device 30 and the vicinity thereof. FIG. 3 is a schematic perspective view of a part (belt unit 32 through 35) of the sheet thickness detecting device 30. FIG. 4 schematically illustrates the operations of the sheet thickness detecting device 30.

As shown in FIG. 2, the sheet thickness detecting device 30 detecting the thickness of the sheet P passing through the conveying path is disposed on the downstream side of the sheet supply unit 12 and the upstream side of the secondary transfer nip (image forming unit) in the sheet feeding direction of the conveying path of the feeding device.

Figure 3:
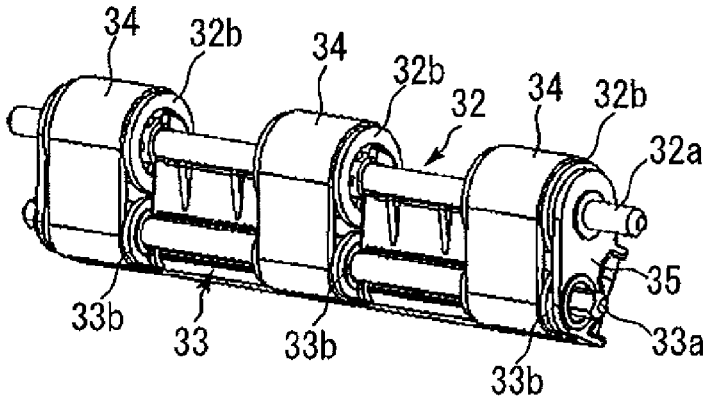
FIG. 3 is a schematic oblique view of a part of the sheet thickness detecting device.

Also, as shown in FIGS. 2 and 3, the sheet thickness detecting device 30 includes a fixed roller 31, a movable roller 32, a shaft roller 33, a feeding belt 34 as a belt member, a swing member 35 (a housing), a detection sensor 41 (displacement amount detecting sensor) as a detecting unit and the like.

The fixed roller 31 is rotatably supported by a shaft so that the outer surface of the fixed roller 31 faces one side of the sheet P passing through the conveying path K. Further, the fixed roller 31 is a roller member including a shaft part and a roller part formed on (outside) the shaft part. The shaft part is made of a metal material or the like, and the roller part is made of, for example, a resin material (or a hard rubber member).

The fixed roller 31 is rotatably supported by a shaft which extends in the width direction (i.e., the direction orthogonal to the sheet surface of FIG. 2), so that both ends of the shaft are supported by the respective shaft bearings (not shown) provided on the side plates (not shown) of the main body of the image forming apparatus 1.

Further, the fixed roller 31 is driven to rotate by a drive motor (not shown) via a series of gears including a gear mounted on the shaft, the gear being provided on one side in the width direction. Then, when the fixed roller 31 is driven to rotate by inputting the driven force of the drive motor. In the case of FIG. 2, the fixed roller 31 is driven to rotate in the clockwise direction.

Similar to the fixed roller 31, the movable roller 32 is also rotatably supported, so that the movable roller 32 and the fixed roller 31 sandwich and feed the sheet P via the feeding belt 34. Namely, as schematically shown in FIG. 2, the feeding belt 34 is disposed between the movable roller 32 and the sheet P.

Further, it should be noted that the movable roller 32 is displaced (moved) in the arrow direction ("D" in FIG. 2) in accordance with the thickness of the sheet P which is sandwiched between the fixed roller 31 and the movable roller 32 (via the feeding belt 34).

As shown in FIG. 3, the movable roller 32 includes plural rollers arranged in the width direction, so that the rollers adjacent to each other are separated from each other by a distance. Each of the plural rollers 32 includes a shaft part 32*a* made of a metal material, and a roller part 32*b* formed on (outside) the shaft part 32*a* and made of a resin material.

The plural rollers 32 are arranged in the width direction (i.e., the direction orthogonal to the sheet of FIG. 2) so that adjacent rollers are separated from each other. The movable roller 32 is rotatably supported by the shaft part 32*a* which extends to a shaft bearing mounted on the swing member 35.

The shaft roller 33 includes a shaft part 33*a* which is disposed on the upstream side of the facing position (nip section) between the fixed roller 31 and the movable roller 32 in the feeding direction of the sheet P. The shaft part 33*a* of the shaft roller 33 is rotatably supported by a shaft bearing mounted on the swing member 35.

As shown in FIG. 3, similar to the movable roller 32, the shaft roller 33 is a roller member including plural rollers which are arranged in the width direction, so that the rollers adjacent to each other are separated from each other by a distance. Each of the plural rollers 33 includes a shaft part 33*a* made of a metal material, and a roller part 33*b* formed on (outside) the shaft part 33*a* and made of a resin material.

The feeding belt 34 serving as the belt member is an endless belt made of a rubber material, and is stretched between and supported by the movable roller 32 (roller part 32*b*) and the shaft roller 33 (roller part 33*b*. Due to a contact pressure from the movable roller 32, the nip section for the sheet P is formed between the feeding belt 34 and the fixed roller 31.

Further, the feeding belt 34 feeds in the feeding direction to feed the sheet P due to frictional resistance between the feeding belt 34 and the fixed roller 31. In this case, as shown the arrow "B" in FIG. 2, the feeding belt 34 is driven to rotate in the clockwise direction.

Also, due to the frictional resistance with the feeding belt 34, the fixed roller 31 and the movable roller 32 are driven to rotate in the clockwise direction.

The swing member 35 is a housing, made of a plate (or resin), supporting the movable roller 32 and the shaft roller 33 so that the movable roller 32 and the shaft roller 33 rotates. The swing member 35 is designed to swing (displace) around the shaft part 33*a* in accordance with the displacement of the movable roller 32 based on the thickness of the sheet P fed into the nip section between the fixed roller 31 and the movable roller 32.

Further, as shown in FIG. 2, the swing member 35 includes a detection target part 35*a* which is disposed at the position opposite to the shaft part 33*a* with respect to the shaft part 32*a*.

Namely the detection target part 35*a* is disposed on the downstream side of the shaft part 32*a* (where the movable roller 32 is rotatably supported) in the sheet feeding direction of the sheer P, and the distance between the detection target part 35*a* and the shaft part 33*a* is greater than that between the shaft part 32*a* to the shaft part 33*a*. The detection target part 35*a* is not shown in FIG. 3.

Specifically, the belt unit including the swing member 35, the movable roller 32, the shaft roller 33, and the feeding belt 34 is rotatably supported by the side plates of the main body of the image forming apparatus 1 via the shaft part 33*a*.

Further, a compressed spring (not shown) is provided on the shaft part 32*a* of the movable roller 32 to bias the movable roller 32 (belt unit) to the fixed roller 31.

Further, the detection target part 35*a* (a protrusion part formed by extending a part of the swing member 35) which is to be detected by the detection sensor 41 (displacement amount detecting sensor) is disposed at the position opposite to the shaft part 33*a* with respect to the shaft part 32*a*, so that the distance between the position and the shaft part 33*a*, which is the center around which the swing member 35 rotates, is sufficiently long.

Further, the displacement amount of the detection target part 35*a* of the swing member 35 is detected by the detection sensor 41 serving as the detecting unit.

Figure 4:
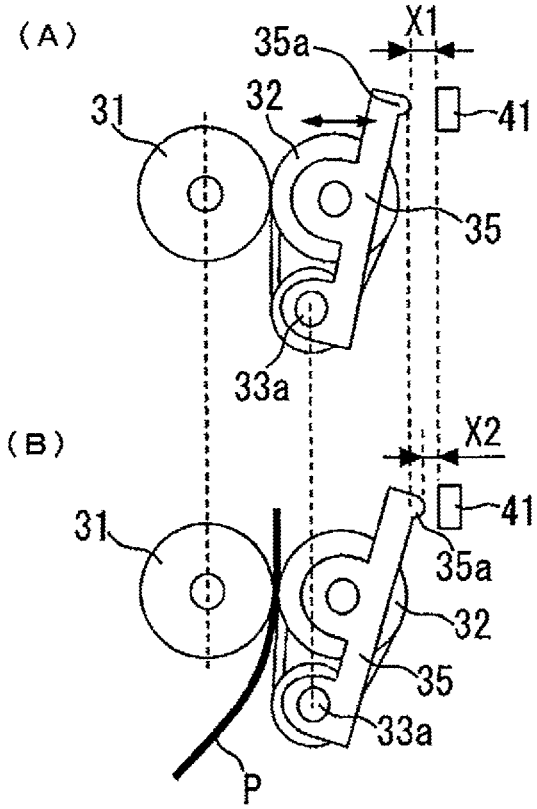
FIG. 4 schematically illustrates example operations of the sheet thickness detecting device.

FIG. 4 schematically illustrates the displacement amount of the detection target part 35*a* of the swing member 35. More specifically, a part (A) of FIG. 4 illustrates a state where nothing (i.e., no sheet P) is sandwiched in the nip section between the fixed roller 31 and the movable roller 32 (feeding belt 34).

In this state, the detection sensor 41 detects the distance "X1" as the distance between the detection sensor 41 and the detection target part 35*a* of the swing member 35 (hereinafter may be referred to as the distance "X")

On the other hand, a part (B) of FIG. 4 illustrates a state where the sheet P is sandwiched in the nip section between the fixed roller 31 and the movable roller 32 (feeding belt 34). In this state, the movable roller 32 is displaced to the right direction of FIG. 4 in accordance with the thickness of the sheet P.

As a result of the displacement of the movable roller 32, the swing member 35 is rotated accordingly around the shaft part 33*a* as the center in the clockwise direction. Then, the detection sensor 41 detects the distance "X2" as the distance between the detection sensor 41 and the detection target part 35*a* of the swing member 35 when the sheet P is sandwiched in the nip section.

Then, the detection results detected by the detection sensor 41 are transmitted to a control unit (calculation unit) 60. In the control unit 60, the displacement amount (X2-X1) of the detection target part 35*a* is calculated.

Further, the displacement amount (X2-X1) is multiplied by an arm ratio which is defined as (distance between shaft part 33*a* and shaft part 32*a*)/(distance between shaft part 33*a* and detection target part 35*a*) to calculate the value "T" which corresponds to the thickness of the sheet P.

Further, based on the calculated value "T" corresponding to the thickness of the sheet P, an image forming condition and a feeding condition may be properly adjusted. For example, when it is determined that the sheet is relatively thick, the transfer efficiency at the secondary transfer nip section is likely to be reduced.

Therefore, in this case, it is possible to adjust to increase the secondary transfer bias voltage to be applied to the secondary transfer roller 89, or to adjust so as to increase the image density of the toner images to be formed on the photoconductive drums 5Y, 5M, 5C, and 5K.

Further, in the case where it is determined that the sheet is relatively thick, the performance of fixing in the fixing process executed in the fixing unit 20 is likely to be reduced because the heat to be applied to the toner image may become insufficient. Therefore, for example, it is possible to adjust to reduce the feeding speed of the recording medium (sheet) P.

As described above, according to an embodiment, in the sheet thickness detecting device 30 according to an embodiment, the displacement of the movable roller 32, which is displaced in accordance with the thickness of the sheet P, is not directly detected by the detection sensor 41. In the sheet thickness detecting device 30 according to an embodiment, it is the displacement amount of the detection target part 35*a* of the swing member 35 that is detected by the detection sensor 41.

In this case, it is the displacement amount of the detection target part 35*a*, which is sufficiently separated in distance from the shaft part 32*a* of the movable roller 32, that is calculated by multiplying the displacement amount of the movable roller 32 by the arm ratio defined as described above.

Therefore, according to an embodiment, it may become possible to more accurately detect the thickness of the sheet P by the detection sensor 41.

For example, even when a sheet P which is extremely thin is fed in the nip section between the between the fixed roller 31 and the movable roller 32 (feeding belt 34), it may become possible to more accurately and reliably detect the thickness of the sheet P. This is because the displacement amount of the movable roller 32 is amplified, so that the amplified displacement amount may be detected by the detection sensor 41.

Further, according to an embodiment, even when an inexpensive sensor having a relatively low detection accuracy is used as the detection sensor 41, the displacement amount of the movable roller 32 in accordance with the thickness of the sheet P is amplified using the arm ratio.

Therefore, it may become possible to accurately detect the thickness of the sheet P as if the displacement amount of the movable roller 32 is detected by using an expensive sensor having relatively high accuracy.

In other words, according to an embodiment, it may become possible to more accurately detect the thickness of the sheet P without using an expensive sensor having relatively high accuracy.

Further, the detection sensor 41 (detecting unit) detecting the displacement amount of the detection target part 35*a* may be a non-contacting type sensor or a contacting type sensor.

Specifically, for example, as the detection sensor 41 (detecting unit), an optical distance measurement sensor which optically detects the displacement amount of (distance to) the detection target part 35*a* may be used.

Further, a lever-type encoder sensor which detects the displacement amount of the lever to be displaced in accordance with the displacement of the detection target part 35*a* may alternatively be used.

Further, a magnetic linear sensor which magnetically detects the displacement of the detection target part 35*a* (made of a metal material) may alternatively used.

Further, direct-acting-type micro displacement sensors disposed on both sides of the detection target part 35*a* in the displacement direction thereof may alternatively used.

The sheet thickness detecting device 30 as described above may be functioned as a feeding device that sandwiches and feeds the sheet P by using the fixed roller 31 and the belt unit. Especially, the feeding belt 34 has a function to promote smooth feeding of the sheet P to the nip section between the fixed roller 31 and the movable roller 32 (feeding belt 34).

Further, according to an embodiment, on the upstream side of the sheet thickness detecting device 30, there is formed a curved conveying path K1 by a curved guide plate (curve guide plate) to curve and feed the sheet P which is fed from the sheet supply unit 12.

Further, at the position between the sheet thickness detecting device 30 and the resist roller pair 37 and 38, there is formed a straight conveying path K2 by a straight guide plate (plane guide plate) to linearly feed the sheet P.

By providing the feeding device (sheet thickness detecting device 30) having the belt unit 32 through 35 disposed on the downstream side of the curved conveying path K1, even when the sheet P is much bent in the curved conveying path K1, the sheet P may be smoothly guided and fed to the nip section between the fixed roller 31 and the movable roller 32 (feeding belt 34) by the feeding belt 34.

Further, according to this embodiment, a case is described where the belt unit including the feeding belt 34, the shaft roller 33 and the like is formed, so that the displacement amount of the detection target part 35*a* of the swing member 35 is detected by the detection sensor 41, the detection target part 35*a* being moved in accordance with the displacement of the movable roller 32.

Figure 5:
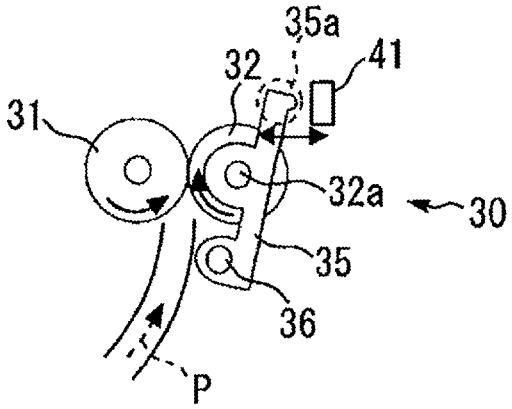
FIG. 5 schematically illustrates an example sheet thickness detecting device according to another embodiment and in the vicinity thereof.

FIG. 5 illustrates another example of the sheet thickness detecting device 30 according to another embodiment. As shown in FIG. 5, there is provided the swing member 35 that swings (rotates) in accordance with the displacement of the movable roller 32 so as to detect the displacement amount of the detection target part 35*a* by the detection sensor 41 even without the feeding belt 34 and the shaft roller 33.

Specifically, in this configuration, the movable roller 32 is rotatably provided so as to directly sandwich and feed the sheet P with the fixed roller 31 without the feeding belt 34.

Further, the swing member 35 rotatably supports the movable roller 32 and swings (rotates) around a shaft 36 in accordance with the displacement of the movable roller 32.

Further, the detection target part 35*a* is formed at the position in a manner that the distance between the detection target part 35*a* and the shaft 36 is greater than that between the detection target part 35*a* and the shaft part 32*a* of the movable roller 32.

Then, the displacement amount of the detection target part 35*a* of the swing member 35 is detected by the detection sensor 41 disposed at the position facing the detection target part 35*a*.

Even in the case described above, similar to the embodiment described first, the displacement amount of the detection target part 35*a* is detected by the detection sensor 41 disposed at the position sufficiently separated from the shaft part 32*a* of the movable roller 32 by amplifying the displacement of the movable roller 32 by the arm ratio of the swing member 35. Therefore, similar to the embodiment described first, it may become possible to more accurately detect the thickness of the sheet by using the detection sensor 41.

As describe above, according to an embodiment, a fixed roller and a movable roller are provided to sandwich and feed a sheet in a conveying path. The movable roller is displaced in accordance with the thickness of the sandwiched sheet. The swing member is swung around a shaft in accordance with the displacement of the movable roller.

The swing member includes a detection target part in a manner that the distance between the detection target part and the shaft is greater than the distance between the movable roller and the shaft. A detection unit detects the distance from the detection target part. By doing this, it may become possible to more accurately detect the thickness of the sheet in the conveying path.

Further, in the embodiment, a case is described where the present invention is applied to the sheet thickness detecting device 30 included in a color image forming apparatus. However, obviously, the present invention may also be applied to a sheet thickness detecting device included in a monochrome image forming apparatus.

Further, according to an embodiment, a case is described where the sheet thickness detecting device 30 is included in the image forming apparatus 1 employing the electophotographic method. However, the present invention is not limited to this configuration.

Namely, the present invention may also be applied to any of the sheet thickness detecting devices included in an image forming apparatus employing another method (e.g., an image forming apparatus employing the inkjet method, a printer employing any method, and the like). In any of the above cases, it may become possible to obtain the same effect as described in the above embodiments of the present invention.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet thickness detecting device for detecting a thickness of a sheet passing through a conveying path, comprising:

a fixed roller rotatably supported by a shaft so that the fixed roller faces one side of the sheet passing through the conveying path;

a movable roller rotatably provided so that the movable roller and the fixed roller sandwich and feed the sheet, and configured to be displaced in accordance with the thickness of the sandwiched sheet;

a swing member configured to rotatably support the movable roller and including a shaft so that the swing member is swung around the shaft, wherein the swing member further includes a detection target part formed in a manner that a distance between the detection target part and the shaft is greater than a distance between a position where the movable roller is supported by the swing member and the shaft;

a detecting unit configured to detect the displacement amount of the detection target part of the swing member;

a shaft roller including the shaft disposed on the upstream side of a position where the movable roller and the fixed roller are facing each other in a sheet feeding direction, and being rotatably supported by the swing member via the shaft; and a belt member configured to be stretched between the movable roller and the fixed roller and move along the sheet feeding direction.

2. The sheet thickness detecting device according to claim 1, wherein the detecting unit is any of an encoder sensor, a linear sensor, a distance measurement sensor, and a micro displacement sensor.

3. A feeding device for feeding a recording medium, comprising:

the sheet thickness detecting device according to claim 1.

4. An image forming apparatus comprising:

the sheet thickness detecting device according to claim 1.

5. The sheet thickness detecting device according to claim 1, wherein the movable roller includes plural rollers arranged in a width direction, the plural rollers are separated from each other by a distance.

6. The sheet thickness detecting device according to claim 5, wherein each of the plural rollers includes a shaft part made of metal material, and a roller part formed on the shaft part and made of resin material.

7. The sheet thickness detecting device according to claim 1, wherein the belt member feeds in a feeding direction to feed the sheet due to frictional resistance between the belt member and the fixed roller.

8. The sheet thickness detecting device according to claim 1, wherein the swing member is a housing, made of a plate, supporting the movable roller and the shaft roller so that the movable roller and the shaft roller rotates thereof.

9. The sheet thickness detecting device according to claim 1, wherein the detection target part is at a position opposite to the shaft of the swing member with respect to the shaft of the movable roller.

10. The sheet thickness detecting device according to claim 9, wherein the detection target part is on a downstream side of the shaft of the movable roller in the sheet feeding direction.

11. The sheet thickness detecting device according to claim 10, wherein a distance between the detection target part and the shaft of the swing member is greater than a distance between the shaft of the movable roller and the shaft of the swing member.

12. The sheet thickness detecting device according to claim 1, further comprising a belt unit, which includes the swing member, the movable roller, the shaft roller, and the belt member, is rotatable supported by side plates of a main body of an image forming apparatus.

13. The sheet thickness detecting device according to claim 1, wherein the detection target part is disposed at a position opposite to the shaft of the swing member with respect to the shaft of the movable roller.

14. The sheet thickness detecting device according to claim 1, wherein the detecting unit is at least one of a non-contacting sensor and a contacting type sensor.

15. The sheet thickness detecting device according to claim 1, further comprising a control unit to calculate the displacement amount of the detection target part.

* * * * *